US011405723B2

(12) United States Patent
Pang et al.

(10) Patent No.: US 11,405,723 B2
(45) Date of Patent: Aug. 2, 2022

(54) METHOD AND APPARATUS FOR PROCESSING AN AUDIO SIGNAL BASED ON EQUALIZATION FILTER

(71) Applicant: HUAWEI TECHNOLOGIES CO., LTD., Shenzhen (CN)

(72) Inventors: Liyun Pang, Munich (DE); Fons Adriaensen, Munich (DE); Roman Schlieper, Hannover (DE); Song Li, Hannover (DE)

(73) Assignee: HUAWEI TECHNOLOGIES CO., LTD., Shenzhen (CN)

( * ) Notice: Subject to any disclaimer, the term of this patent is extended or adjusted under 35 U.S.C. 154(b) by 0 days.

(21) Appl. No.: 17/245,294

(22) Filed: Apr. 30, 2021

(65) Prior Publication Data

US 2021/0250686 A1 Aug. 12, 2021

Related U.S. Application Data

(63) Continuation of application No. PCT/EP2019/053898, filed on Feb. 15, 2019.

(51) Int. Cl.

| | |
|---|---|
| ***H04R 3/04*** | (2006.01) |
| ***G10K 11/00*** | (2006.01) |
| ***H04R 1/10*** | (2006.01) |

(52) U.S. Cl.

CPC ..... *H04R 3/04* (2013.01); *G10K 11/002* (2013.01); *H04R 1/1083* (2013.01); *H04R 2460/05* (2013.01)

(58) Field of Classification Search

CPC .... H04R 2460/05; H04R 1/1083; H04R 3/04; G10K 11/002

USPC ..... 381/98

See application file for complete search history.

(56) References Cited

U.S. PATENT DOCUMENTS

| | | | | |
|---|---|---|---|---|
| 8,798,283 | B2 | 8/2014 | Gauger, Jr. et al. | |
| 9,020,160 | B2 | 4/2015 | Gauger, Jr. | |
| 9,301,040 | B2 | 3/2016 | Annunziato et al. | |
| 9,832,582 | B2 * | 11/2017 | Chen | H04M 1/605 |
| 2007/0005251 | A1 * | 1/2007 | Chemali | G01V 1/44 702/6 |

(Continued)

FOREIGN PATENT DOCUMENTS

| | | | |
|---|---|---|---|
| CN | 101040565 | A | 9/2007 |
| CN | 107770710 | A | 3/2018 |
| KR | 20120094045 | A | 8/2012 |

OTHER PUBLICATIONS

Gan, et al., "Natual and Augmented Listening for VR/AR/MR", ICASSP 2018 Tutorial T11; 251 pages.

(Continued)

*Primary Examiner* — Vivian C Chin
*Assistant Examiner* — Friedrich Fahnert
(74) *Attorney, Agent, or Firm* — Maier & Maier, PLLC

(57) ABSTRACT

A method for processing an audio signal, the method including: processing the audio signal according to a pair of mouth to ear transfer functions to obtain a processed audio signal; filtering the processed audio signal, using a pair of equalization filters, to obtain a filtered audio signal, where a parameter of the equalization filter is depends on an acoustic impedance of a headphone; and outputting the filtered audio signal to the headphone. Accordingly, this method counteracts the occlusion effect and to provides a natural perceived sound pressure.

13 Claims, 14 Drawing Sheets

(56) References Cited

U.S. PATENT DOCUMENTS

| | | | | |
|---|---|---|---|---|
| 2014/0126735 | A1 | 5/2014 | Gauger, Jr. | |
| 2016/0127829 | A1* | 5/2016 | Ring | H04R 1/10 381/61 |
| 2016/0210958 | A1 | 7/2016 | Gauger, Jr. et al. | |

OTHER PUBLICATIONS

Vorländer, "Acoustic load on the ear caused by headphones", The Journal of the Acoustical Society of America, 2000, vol. 107, No. 4; 4 pages.

Liebich, et al., "Active Occlusion Cancellation with Hear-Through Equalization for Headphones", ICASSP 2018; 5 pages.

Schlieper, et al., "Estimation of the Headphone "Openness" Based on Measurements of Pressure Division Ratio, Headphone Selection Criterion, and Acoustic Impedance", AES 145th Convention, 2018; 6 pages.

ISO 10534-2, "Acoustics—Determination of sound absorption coefficient and impedance in impedance tubes—Part 2: Transfer-function method", 1998; 11 pages.

* cited by examiner

METHOD AND APPARATUS FOR PROCESSING AN AUDIO SIGNAL BASED ON EQUALIZATION FILTER

CROSS-REFERENCE TO RELATED APPLICATIONS

This application is a continuation of International Application No. PCT/EP2019/053898, filed on Feb. 15, 2019, the disclosure of which is hereby incorporated by reference in its entirety.

TECHNICAL FIELD

The embodiments relate to the field of audio signal processing and reproduction. More specially, the embodiments relate to a method for processing an audio signal based using an equalization filter and an apparatus for processing an audio signal based on equalization filter. The embodiments also relate to a computer-readable storage medium.

BACKGROUND

Headphones are a pair of small loudspeaker drivers worn on or around the head and over a user's ears. Headphones are electroacoustic transducers, which convert an electrical signal to a corresponding sound. Headphones enable a single user to listen to an audio source privately, in contrast to a loudspeaker, which emits sound into the open air for anyone nearby to hear. Headphones are also known as earspeakers or earphones. Circumaural ('around the ear') and supra-aural ('on the ear') headphones use a band over the top of the head to hold the speakers in place. The other type, known as earbuds or earpieces consist of individual units that plug into the user's ear canal. In the context of telecommunication, a headset is a combination of headphone and microphone. Headphones connect to a signal source such as an audio amplifier, radio, CD player, portable media player, mobile phone, video game console, or electronic musical instrument, either directly using a cord, or using wireless technology such as Bluetooth or FM radio.

Acoustically closed headphones are preferred to attenuate the outside noise as much as possible and to achieve a good audio reproduction quality due to a better signal to noise ratio in noisy environments. Closed headphones, especially "intra-aural" (in-ear) and "intra-concha" (earbud) headphones which seal the ear-canal, are likely to increase the acoustic impedance seen from the inside of the ear-canal to the outside. An increased acoustic impedance is followed by an increased sound pressure level for low frequencies inside the ear canal. In the case of self-generated sound, for example, speaking, rubbing and buzzing noise, the sound is perceived as unnaturally amplified and uncomfortable while listening or speaking. This effect is commonly described as the occlusion effect.

As shown in FIG. 1, the sound pressure at the eardrum is a summation of the sound generated by the larynx 101 transmitted through the mouth 104 to the beginning of the ear canal 103 and the transmitted body-conducted sound. FIG. 1 shows the open ear scenario (reference scenario) in which no occlusion effect occurs. Hme represents the transfer path from the mouth 104 to the inner ear 102 through the air, and Hb represents the transfer path from the larynx to the inner ear 102 through bones.

If the ear canal is closed with headphones, as schematically shown in FIG. 2, the sound transmitted through the air (Hme) is damped with the isolation curve of the headphone (105). The signal path through the body (Hb) remains unchanged. Sealing the ear canal with the headphone has the effect of amplifying the sound pressure in front of the ear drum in low frequencies. This causes the occlusion effect.

In FIG. 3, the occlusion effect is illustrated by comparing two sound pressure level spectra measured inside the ear canal. The dashed curve shows the sound pressure for the unoccluded open ear. The solid curve shows the sound pressure level inside the ear canal of the same subject wearing circumaural (over-ear) headphones. It can be seen that the sound pressure level is increased in the frequency range between approximately 60 Hz and 400 Hz.

"Naturalness" is one of the important perceptual attributes for sound reproduction over headphones. Naturalness is defined as the feeling of the user to be fully immersed in the original environment. In the case of a "listening only" scenario, this is a binaural recording at the entrance of the ear canal which is played back (ambient sound). From the moment the user starts to speak, the reproduction of ambient sounds is less important and the immersion is attenuated. In the scenario of a user who is speaking or participating in a teleconference, the ambient sound is less important. Therefore, it is more important to ensure that the perception of the own voice when the user wears a headset is as close as to the perception without a headset. However, the naturalness is affected by wearing acoustically closed headphones, especially the in-ear headphones, since such headphones have a strong occlusion effect.

SUMMARY

The embodiments relate to binaural audio reproduction over headphones. An object of the embodiments is to reduce the occlusion effect for in-ear or earbud headphones by capturing user's own voice with the in-line microphone of a headset, and embodiments also could be used for over-ear or on-ear headsets. The headset is processed with an anti-occlusion algorithm to create a natural sound pressure distribution inside the ear canal.

A first aspect of the embodiments provides a method for processing an audio signal, the method including: processing the audio signal according to a pair of mouth to ear transfer functions, to obtain a processed audio signal; filtering the processed audio signal, using a pair of equalization filters, to obtain a filtered audio signal, where a parameter of the equalization filter depends on an acoustic impedance of a headphone; and outputting the filtered audio signal to the headphone.

According to the audio processing method in the first aspect, an occlusion effect for in-ear or earbud headphones has been reduced, and a natural sound pressure distribution inside the ear canal is created.

An audio signal is a representation of sound, typically using a level of electrical voltage for analog signals, and a series of binary numbers for digital signals. Audio signals have frequencies in the audio frequency range of roughly 20 to 20,000 Hz, which corresponds to the upper and lower limits of human hearing. Audio signals may be synthesized directly or may originate at a transducer such as a microphone, musical instrument pickup, phonograph cartridge, or tape head. Loudspeakers or headphones convert an electrical audio signal back into sound.

In an example, an audio signal may be obtained by a receiver. For example, the receiver may obtain the audio signal from another device or another system via a wired or wireless communication channel.

In another example, an audio signal may be obtained using a microphone and a processor. The microphone is used to record information obtained from a sound source, and the processor is used to process the information recorded by the microphones, to obtain the audio signal.

In one implementation form of the first aspect, the mouth to ear transfer function describes a transfer function from the mouth to the eardrums.

In one implementation form of the first aspect, the mouth to ear transfer function is obtained using a head and torso simulator; or the mouth to ear transfer function is obtained using a real person.

In an example, a head and torso simulator equipped with mouth and ear simulators provides an approach to the measurement of HmeTFs. The transfer functions or impulse response from an input signal (fed to the loudspeaker of the mouth simulator) to the output signals (from the ear microphones) are measured.

In another example, a transfer function can be measured from a microphone or a speaker near the mouth to the ear microphones. Compared with the above example which refers to a head and torso simulator, using a real person has the advantage of removing the response of the mouth simulator from the measurement, and is also well-suited to simulation—as a talking subject can have a microphone positioned similarly near their mouth as part of the simulation system.

Equalization is the process of adjusting the balance between frequency components within an electronic signal. In sound recording and reproduction, equalization is the process commonly used to alter the frequency response of an audio system using linear filters or other type filters. The circuit or equipment used to achieve equalization is called an equalization filter or an equalizer. These devices strengthen (boost) or weaken (cut) the energy of specific frequency bands or "frequency ranges".

Common equalizers or filters in music production are parametric, semi-parametric, graphic, peak, and program equalizers or filters. Graphic equalizers or filters are often included in consumer audio equipment and software which plays music on home computers. Parametric equalizers or filters require more expertise than graphic equalizers, and they can provide more specific compensation or alteration around a chosen frequency. This may be used in order to remove unwanted resonances or boost certain frequencies.

Acoustic impedance is the ratio of acoustic pressure to flow. In an example, the acoustic impedance according to the standard ISO-10534-2 is defined as the "ratio of the complex sound pressure p(0) to the normal component of the complex sound particle velocity v(0) at an individual frequency in the reference plane". The reference plane is the cross-section of the impedance tube for which the impedance Z (or the reflection factor r, or the admittance G) are determined and is a surface of a test object. The reference plane is assumed to be at x=(in our context, this is the end of the tube, where the test object starts). Therefore, p(0) describes the complex sound pressure at the end of the tube and v(0) describes the complex particle velocity at the end of the tube. Complex sound pressure p and complex sound pressure v denote the Fourier transform of these parameters in the time domain.

In an example, for a linear time-invariant system, the relationship between the acoustic pressure applied to the system and the resulting acoustic volume flow rate through a surface perpendicular to the direction of that pressure at its point of application is given by $$p(t)=[R*Q](t),$$

or equivalently by $$Q(t)=[G*p](t),$$

where p is the acoustic pressure;

Q is the acoustic volume flow rate;

* is the convolution operator;

R is the acoustic resistance in the time domain;

$G=R^{-1}$ is the acoustic conductance in the time domain ($R^{-1}$ is the convolution inverse of R).

Acoustic impedance, denoted Z, is the Laplace transform, or the Fourier transform, or the analytic representation of time domain acoustic resistance:

$$Z(s) \stackrel{def}{=} \mathcal{L}[R](s) = \frac{\mathcal{L}[p](s)}{\mathcal{L}[Q](s)},$$

$$Z(\omega) \stackrel{def}{=} \mathcal{F}[R](\omega) = \frac{\mathcal{F}[p](\omega)}{\mathcal{F}[Q](\omega)},$$

$$Z(\omega) \stackrel{def}{=} R_a(t) = \frac{1}{2}[p_a * (Q^{-1})_a](t),$$

where $\mathcal{L}$ is the Laplace transform operator;

$\mathcal{F}$ is the Fourier transform operator;

subscript "a" is the analytic representation operator;

$Q^{-1}$ is the convolution inverse of Q.

In one implementation form of the first aspect, the acoustic impedance of the headphone is measured based on an acoustic impedance tube. The acoustic impedance tube may have a measurable frequency range from 20 Hz to 2 kHz, for example.

In one implementation form of the first aspect, the parameter of the equalization filter is a gain factor of the equalization filter, the gain factor of the equalization filter is proportional to the inverse of the acoustic impedance of the headphone.

In an example, a gain factor or a shape (g) of an equalization filter is proportional to the inverse of $Z_{HP}$.

$$g = \alpha \frac{1}{Z_{HP}},$$

where $\alpha$ is the scaling factor (proportional coefficient), which can either be selected by the user or determined during measurements of different headphones.

In one implementation form of the first aspect, the pair of equalization filters is selected based on a headphone type of the headphone.

In an example, the equalization filter is pre-designed based on the acoustic impedance of the headphone. Therefore, information of the headphone used is required. Select the headphone type can be done either manually or automatically. For example, the headphone type can be selected by the user manually based on the headphone categories (for example, over-ear headphone, on-ear headphone) or the headphone model (for example HUAWEI Earbud). The headphone type can also be selected automatically detected by the information provided by the USB type-C. For each headphone, the equalization filter is then chosen based on the headphone's acoustic impedance, as mentioned above. For each category, a filter can be designed based on an averaged acoustic impedance or use a representative equalization filter for each category.

In one implementation form of the first aspect, the headphone type of the headphone is obtained based on a Universal Serial Bus (USB) Type-C information.

A second aspect of the embodiments provides an apparatus for processing a stereo signal, where the apparatus includes processing circuitry configured to: process the audio signal according to a pair of mouth to ear transfer functions, to obtain a processed audio signal; filter the processed audio signal, using a pair of equalization filters, to obtain a filtered audio signal, where a parameter of the equalization filter depends on an acoustic impedance of a headphone; and output the filtered audio signal to the headphone.

The processing circuitry may include hardware and software. The hardware may include analog or digital circuitry, or both analog and digital circuitry. In one embodiment, the processing circuitry includes one or more processors and a non-volatile memory connected to the one or more processors. The non-volatile memory may carry executable program code which, when executed by the one or more processors, causes the apparatus to perform the operations or methods described herein.

In one implementation form of the second aspect, the mouth to ear transfer function describes a transfer function from the mouth to the eardrums.

In one implementation form of the second aspect, the acoustic impedance of the headphone is measured based on an acoustic impedance tube, the acoustic impedance tube has a measurable frequency range from 20 Hz to 2 kHz.

In one implementation form of the second aspect, where the parameter of the equalization filter is a gain factor of the equalization filter, the gain factor of the equalization filter is proportional to the inverse of the acoustic impedance of the headphone.

In one implementation form of the second aspect, where the pair of equalization filters is selected based on a headphone type of the headphone.

In one implementation form of the second aspect, the headphone type of the headphone is obtained based on a (USB) Type-C information.

The filters described in the embodiments may be implemented in hardware or in software or in a combination of hardware and software.

A third aspect of the embodiments relates to a computer-readable storage medium storing program code. The program code includes instructions for carrying out the method of the first aspect or one of its implementations.

The embodiments can be implemented in hardware and/or software.

BRIEF DESCRIPTION OF THE DRAWINGS

To illustrate the features of embodiments of the embodiments more clearly, the accompanying drawings provided for describing the embodiments are introduced briefly in the following. The accompanying drawings in the following description are merely some embodiments, but modifications on these embodiments are possible without departing from their scope.

Figure 1:
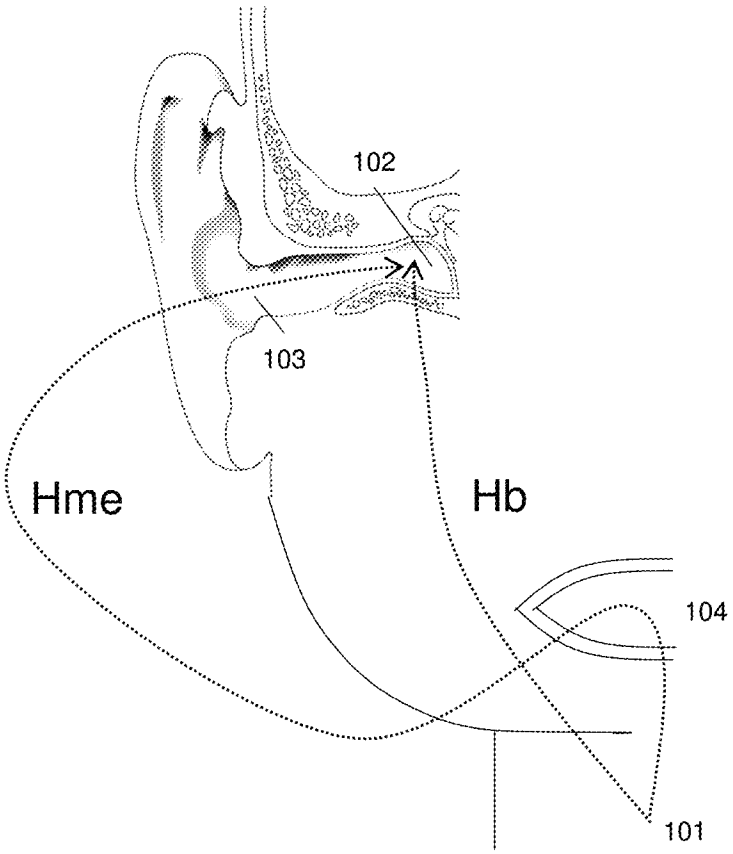
FIG. 1 shows an example about open ear scenario (reference scenario) in which no occlusion effect occurs.
Figure 2:
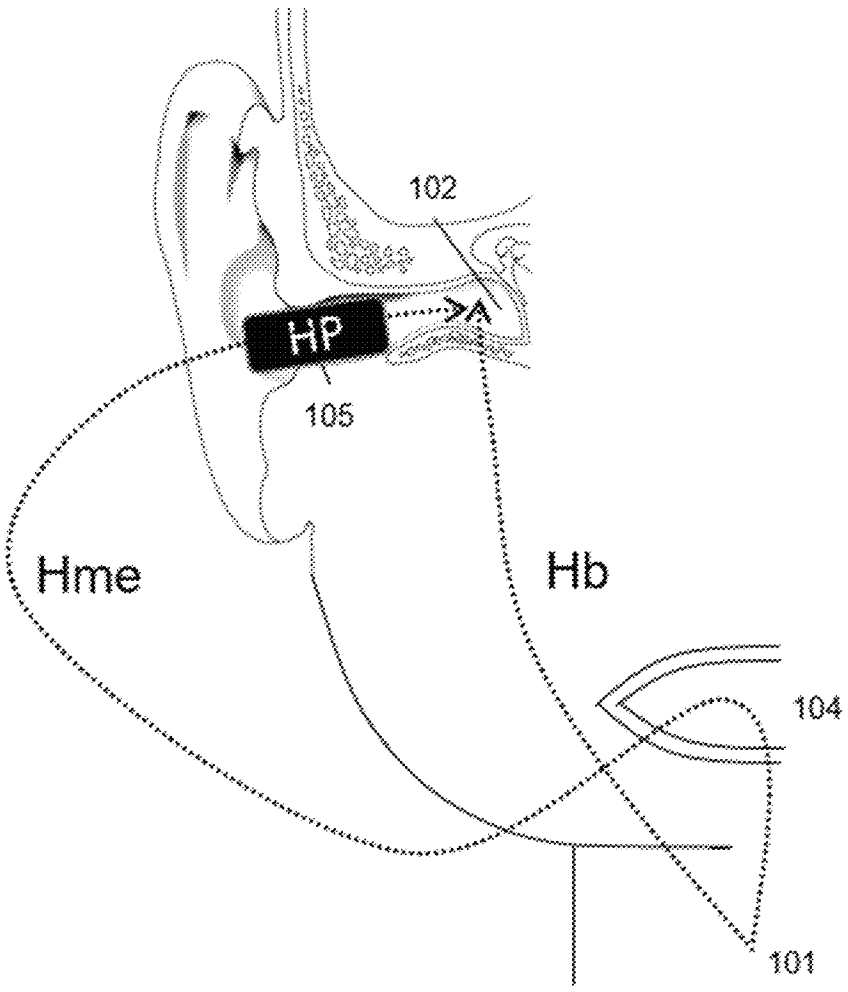
FIG. 2 shows an example of an ear scenario (reference scenario) in which occlusion effect occurs.
Figure 3:
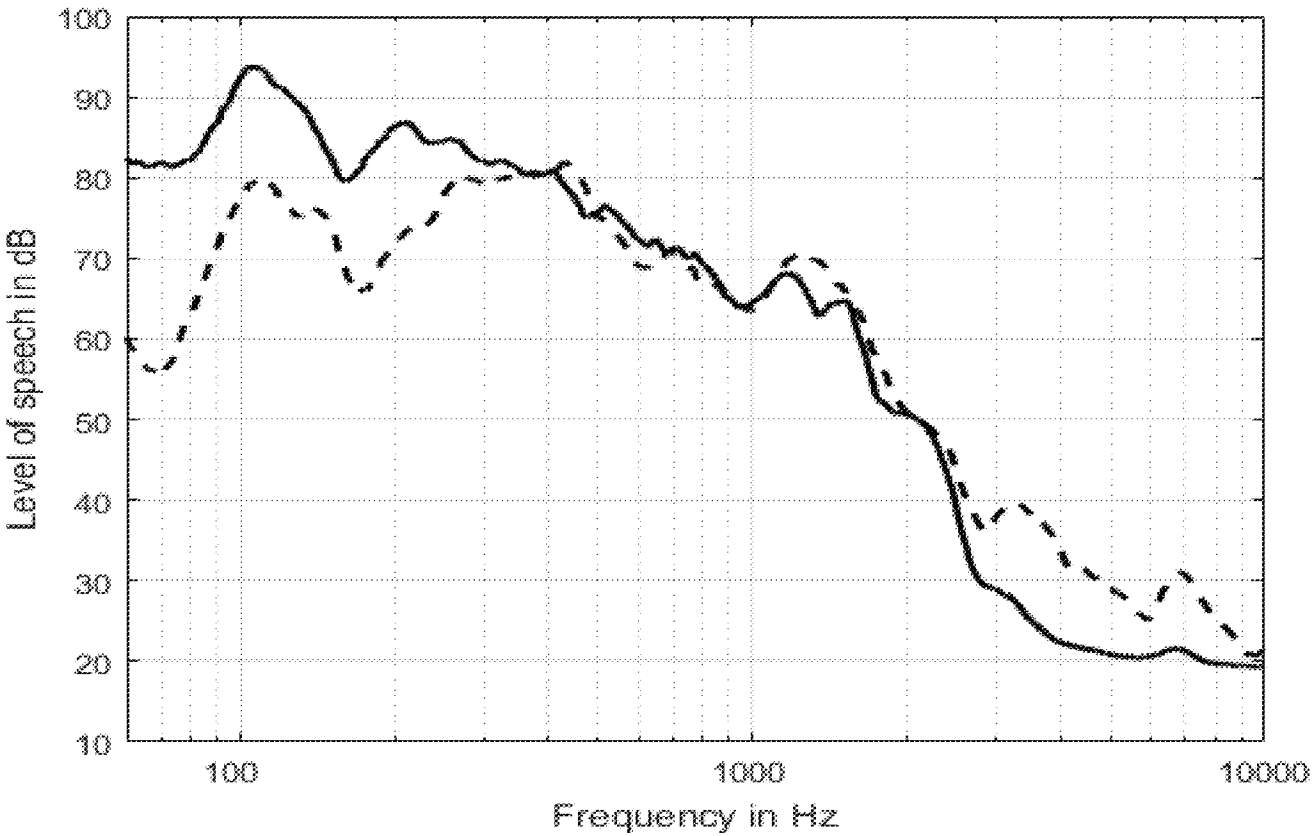
FIG. 3 shows an example about the occlusion effect by comparing two sound pressure level spectra measured inside the ear canal.

In the figures, identical reference signs are be used for identical or functionally equivalent features.

DETAILED DESCRIPTION OF THE EMBODIMENTS

In the following description, reference is made to the accompanying drawings, which describe embodiments, and in which are shown, by way of illustration, various aspects in which the embodiments may be placed. It can be appreciated that the embodiments may be placed in other aspects and that structural or logical changes may be made without departing from the scope of the embodiments. The following descriptions, therefore, are non-limiting.

For instance, it can be appreciated that an embodiment in connection with a described method will generally also hold true for a corresponding device or system configured to perform the method and vice versa. For example, if a specific method step is described, a corresponding device may include a unit to perform the described method step, even if such unit is not explicitly described or illustrated in the figures.

Moreover, embodiments with functional blocks or processing units are described, which are connected with each other or exchange signals. It can be appreciated that the embodiments also cover embodiments which include additional functional blocks or processing units, such as pre- or post-filtering and/or pre- or post-amplification units, that are arranged between the functional blocks or processing units of the embodiments described below.

Finally, it is understood that the features of the various exemplary aspects described herein may be combined with each other, unless specifically noted otherwise.

A channel is a pathway for passing on information, in this context sound information. Physically, it might, for example, be a tube you speak down, or a wire from a microphone to an earphone, or connections between electronic components inside an amplifier or a computer.

A track is a physical home for the contents of a channel when recorded on magnetic tape. There can be as many parallel tracks as technology allows, but for everyday purposes there are 1, 2 or 4. Two tracks can be used for two independent mono signals in one or both playing directions, or a stereo signal in one direction. Four tracks (such as a cassette recorder) are organized to work pairwise for a stereo signal in each direction; a mono signal is recorded on one track (same track as the left stereo channel) or on both simultaneously (depending on the tape recorder or on how the mono signal source is connected to the recorder).

A mono sound signal does not contain any directional information. In an example, there may be several loudspeakers along a railway platform and hundreds around an airport, but the signal remains mono. Directional information cannot be generated simply by sending a mono signal to two "stereo" channels. However, an illusion of direction can be conjured from a mono signal by panning it from channel to channel.

A stereo sound signal may contain synchronized directional information from the left and right aural fields. Consequently, it uses at least two channels, one for the left field and one for the right field. The left channel is fed by a mono microphone pointing at the left field and the right channel by a second mono microphone pointing at the right field (you can also find stereo microphones that have the two directional mono microphones built into one piece). In an example, Quadraphonic stereo uses four channels, surround stereo has at least additional channels for anterior and posterior directions apart from left and right. Public and home cinema stereo systems can have even more channels, dividing the sound fields into narrower sectors.

Stereophonic sound or, more commonly, stereo, is a method of sound reproduction that creates an illusion of multi-directional audible perspective. This is usually achieved by using two or more independent audio channels through a configuration of two or more loudspeakers (or stereo headphones) in such a way as to create the impression of sound heard from various directions, as in natural hearing.

Figure 4:
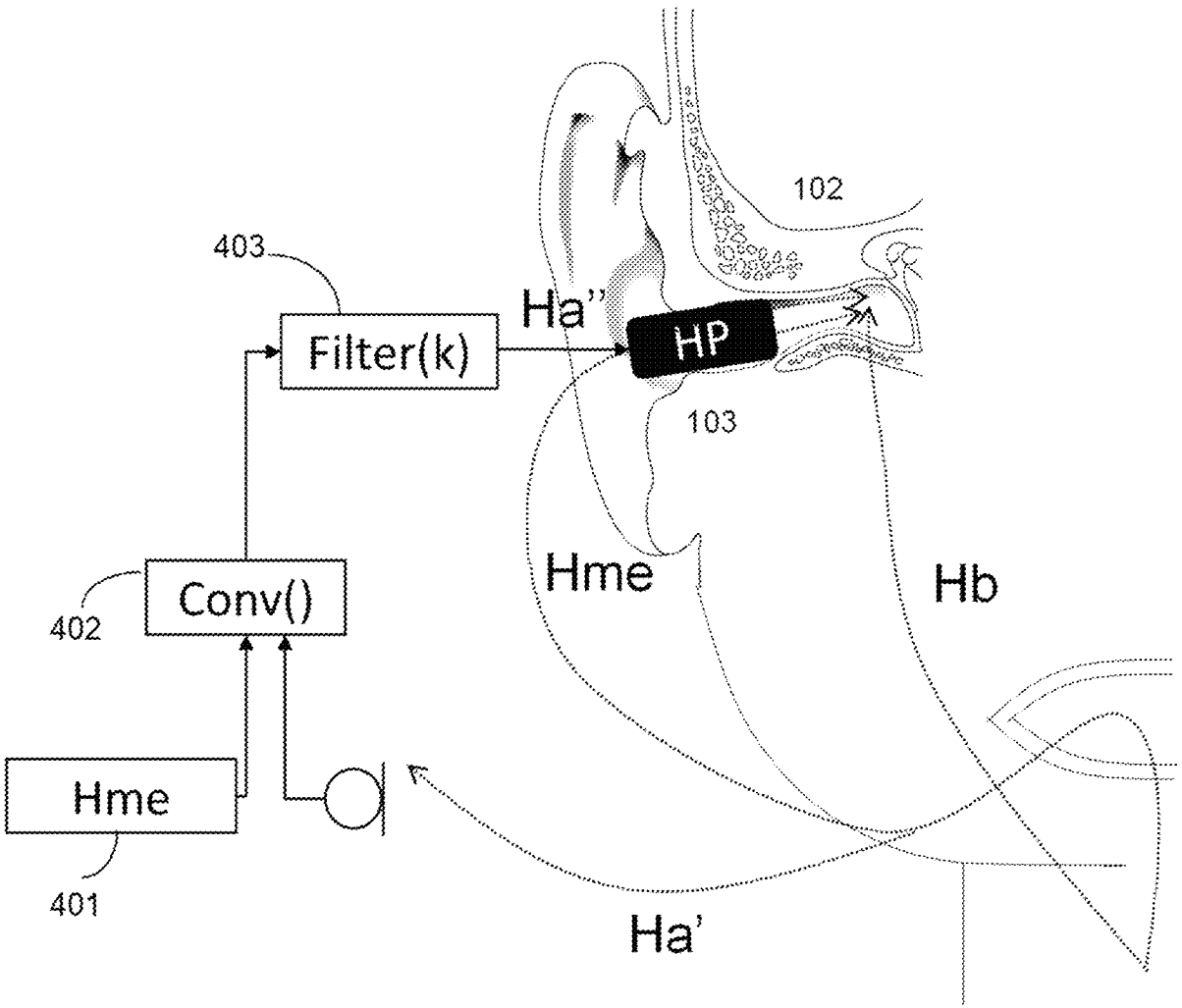
FIG. 4 shows a schematic diagram of a method for reducing the occlusion effect according to an embodiment.

In one embodiment, the object of the audio signal processing method or audio signal processing apparatus is to improve the naturalness and to reduce the occlusion effect when using in-ear headphones, and to counteract the occlusion effect and to provide a sound pressure that can be perceived as natural. In an example, the user's voice is captured by the in-line microphone and convolved 402 with a pair of mouth to ear transfer function (HmeTF) 401 for left/right ear form a recorded or a database, respectively (FIG. 4). The resulting signal is filtered (k) with an equalization filter (anti-occlusion filter) 403 which is designed based on the acoustic impedance of the used headphone.

A head-related transfer function (HRTF) is a response that characterizes how an ear receives a sound from a point in space. As sound strikes the listener, the size and shape of the head, ears, ear canal, density of the head, size and shape of nasal and oral cavities, all transform the sound and affect how it is perceived, boosting some frequencies and attenuating others. Generally speaking, the HRTF boosts frequencies from 2-5 kHz with a primary resonance of +17 dB at 2,700 Hz.

A pair of HRTFs for two ears can be used to synthesize a binaural sound that seems to come from a particular point in space. It is a transfer function, describing how sound from a specific point will arrive at the ear (generally at the outer end of the auditory canal). HRTFs for left and right ear describe the filtering of sound by the sound propagation paths from the source to the left and right ears, respectively. The HRTF can also be described as the modifications to a sound from a direction in free air to the sound as it arrives at the eardrum.

Figure 5:
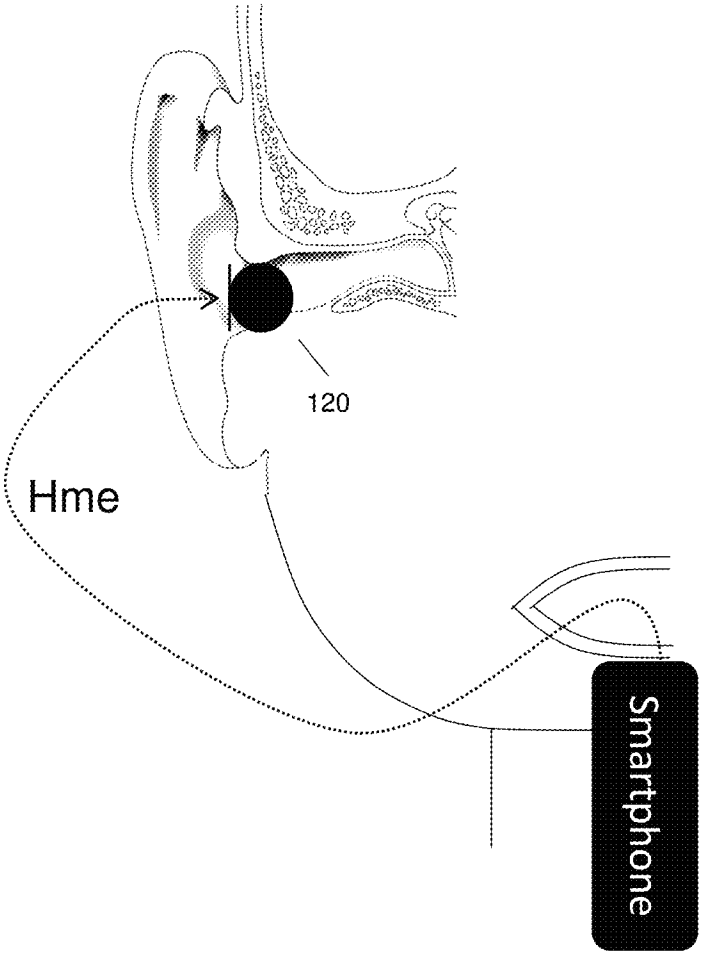
FIG. 5 shows an example of measurement of a mouth to ear transfer function.

The mouth to ear transfer function (HmeTF) describes the transfer function from the mouth to the eardrums. HmeTF can be measured non-individually by using a dummy head (head-torso with mouth simulator), or HmeTF can be measured individually by placing a smartphone or microphone close to the mouth of a user and reproducing a measurement signal. The measurement signal is acquired by microphones placed near the entrance of the blocked ear canal (120). The measurement signal can be a noise signal. FIG. 5 shows an example of a measurement of an individual HmeTF. If a non-individual HmeTF is used, it can be measured once and provided to many users. If an individual HmeTF is required, it needs to be measured once for each user.

In an example, a HmeTF measurement can be made of a real room environment from the mouth to the ears of the same head. For simulation, a talker's voice is convolved in real-time with the HmeTF, so that the talker can hear the sound of his or her own voice in the simulated room environment. It can be shown by example how HmeTF measurements can be made using human subjects (by measuring the transfer function of speech) or by a head and torso simulator.

In an example, a HmeTF is measured using a head and torso simulator (HATS). The mouth simulator directivity of the HATS is similar to the mean long term directivity of conversational speech from humans, except in the high frequency range. The HATS' standard mouth microphone position (known as the 'mouth reference point') is 25 mm away from the 'center of lip' (which in turn is 6 mm in front of the face surface). A microphone is used at the mouth reference point. Rather than using the inbuilt microphones of the HATS (which are at the acoustic equivalent to eardrum position), some microphones that are positioned near the entrance of the ear canals are used. One reason is that a microphone setup similar to the one of the HATS is used on a real person. The microphone setup on the real person includes microphones which may be similar or identical to the microphones of the HATS microphones and which are placed at positions equivalent to those of the HATS. Another reason is that it is desirable to avoid measuring with ear canal resonance, as the strong resonant peaks would need to be inverted in the simulation, which would introduce noise and perhaps latency.

In another example, the measurement about the HmeTF is made by sending a swept sinusoid test signal to the mouth loudspeaker, the sound of which was recorded at the mouth and ear microphones. The sweep ranged between 50 Hz-15 kHz, with a constant sweep rate on the logarithmic frequency scale over a period of 15 s. A signal suitable for deconvolving the impulse response from the sweep was sent directly to the recording device, along with the three microphone signals. This yielded the impulse response (IR) from the signal generator to a microphone, and the transfer function is obtained from the mouth microphone to ear microphones by dividing the latter by the former in the frequency domain The procedure for this is, first, to take the Fourier transform of the direct sound from the mouth microphone impulse response, zero-padded to be twice the length of the desired impulse response. The direct sound is identified by the maximum absolute value peak of the mouth microphone IR, and data from −2 to +2 ms around this is used, with a Tukey window function applied (50% of the window is fade-in and fade-out using half periods of a raised cosine, and the central 50% has a constant coefficient of 1).

In another example, a Fourier transform window length is used for the ear microphone impulse responses, with the second half of the window zero-padded. The transfer function is obtained by dividing the cross-spectrum (conjugate of mouth IR multiplied by the ear IR) by the auto-spectrum of the mouth microphone's direct sound. Before returning to the time domain, a band-pass filter is applied to the transfer function to be within 100 Hz-10 kHz to avoid signal-to-noise ratio problems at the extremes of the spectrum (this is done by multiplying the spectrum components outside this range by coefficients approaching zero). After applying an inverse Fourier transform, the impulse response is truncated (discarding the latter half). The resulting IR for each ear is multiplied by the respective ratio of mouth-to-ear rms values of microphone calibration signals (sound pressure level of 94 dB) to compensate for differences in gain between channels of the recording system.

In another example, HmeTFs can be measured using a real person and using a microphone arrangement similar or identical to the one used in a HATS. The sound source could simply be speech, although other possibilities exist. The transfer function is calculated between a microphone near the mouth to each of the ear microphones. This approach was taken in measuring the transfer function from mouth to ear (without room reflections), and it can be used for measuring room reflections too. Advantages of using such a technique (compared to using the HATS) may include matching the individual long term speech directivity of the person; matching the head related transfer functions of the person's ears; and that the measurement system only requires minimal equipment.

In an example, the formula of the HmeTF depends on how it is measured, generally it is the ratio between the complex sound signal at the ear and at the mouth, HmeTF=p_ear/p_mouth.

In another example, the HmeTF is measured using a real person and a smartphone. The microphone setup can be similar to the other examples and the smartphone has to be positioned near to the mouth. The smartphone acts as a sound source and as the reference microphone. The transfer function is calculated between the smartphone microphone (reference microphone) and the ear microphones. The advantages of this method is the increased bandwidth of the sound source compared with the speech of the real person.

Figure 6:
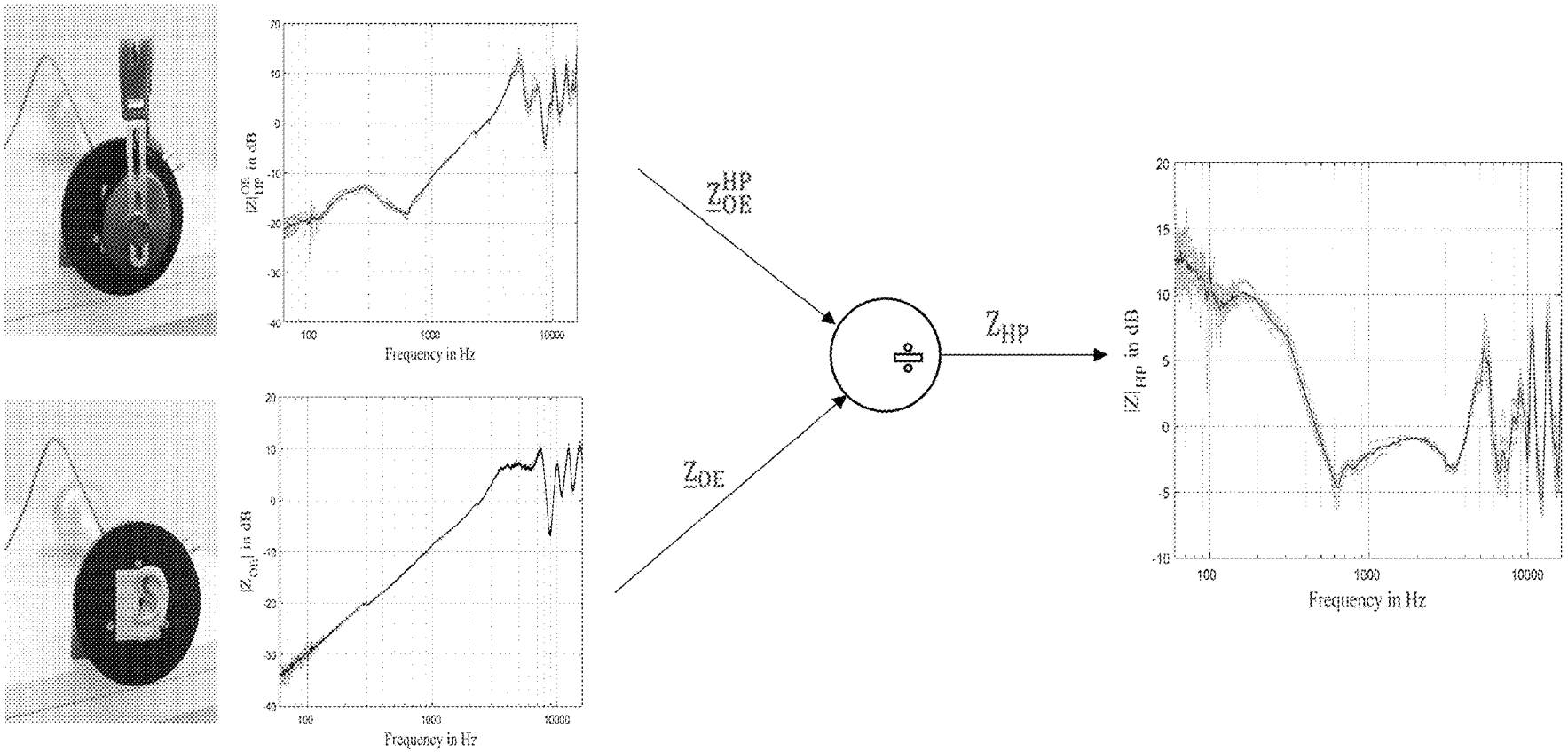
FIG. 6 shows a schematic diagram of measure an acoustic impedance of a headphone by using an acoustic impedance tube according to an embodiment.

Parameters of the equalization filter are based on the acoustic impedance of the headphone. The acoustic impedance of the headphone in low frequency is highly correlated with the perceived occlusion effect, i.e., high acoustic impedance corresponds to high occlusion effect caused by the headphone. The acoustic impedance of the headphone can be measured using a customized acoustic impedance tube, for example an acoustic impedance tube built in accordance with ISO-10534-2.The measurement tube may be built to fit the geometries of a human ear canal, for example, the inner diameter of the tube should be approx. 8 mm, and a frequency range should be between at least 60 Hz and 2 kHz. As shown in FIG. 6, the acoustic impedances of 1) the artificial ear with headphone ($\underline{Z}_{OE}^{Hp}$) and 2) the artificial ear without headphone ($\underline{Z}_{OE}$) are measured. Then the acoustic impedance of the headphone ($Z_{HP}$) can be determined by calculating the ratio between the $\underline{Z}_{OE}^{Hp}$ and $\underline{Z}_{OE}$:

$$Z_{HP} = \frac{|\underline{Z}|_{OE}^{Hp}}{|\underline{Z}|_{OE}}.$$

In another example, the acoustic impedance of the headphone ($Z_{HP}$) may be determined by calculating the difference between the $\underline{Z}_{OE}^{Hp}$ and $\underline{Z}_{OE}$:

$$Z_{HP}=\underline{Z}_{OE}^{Hp}-\underline{Z}_{OE}.$$

Figure 7:
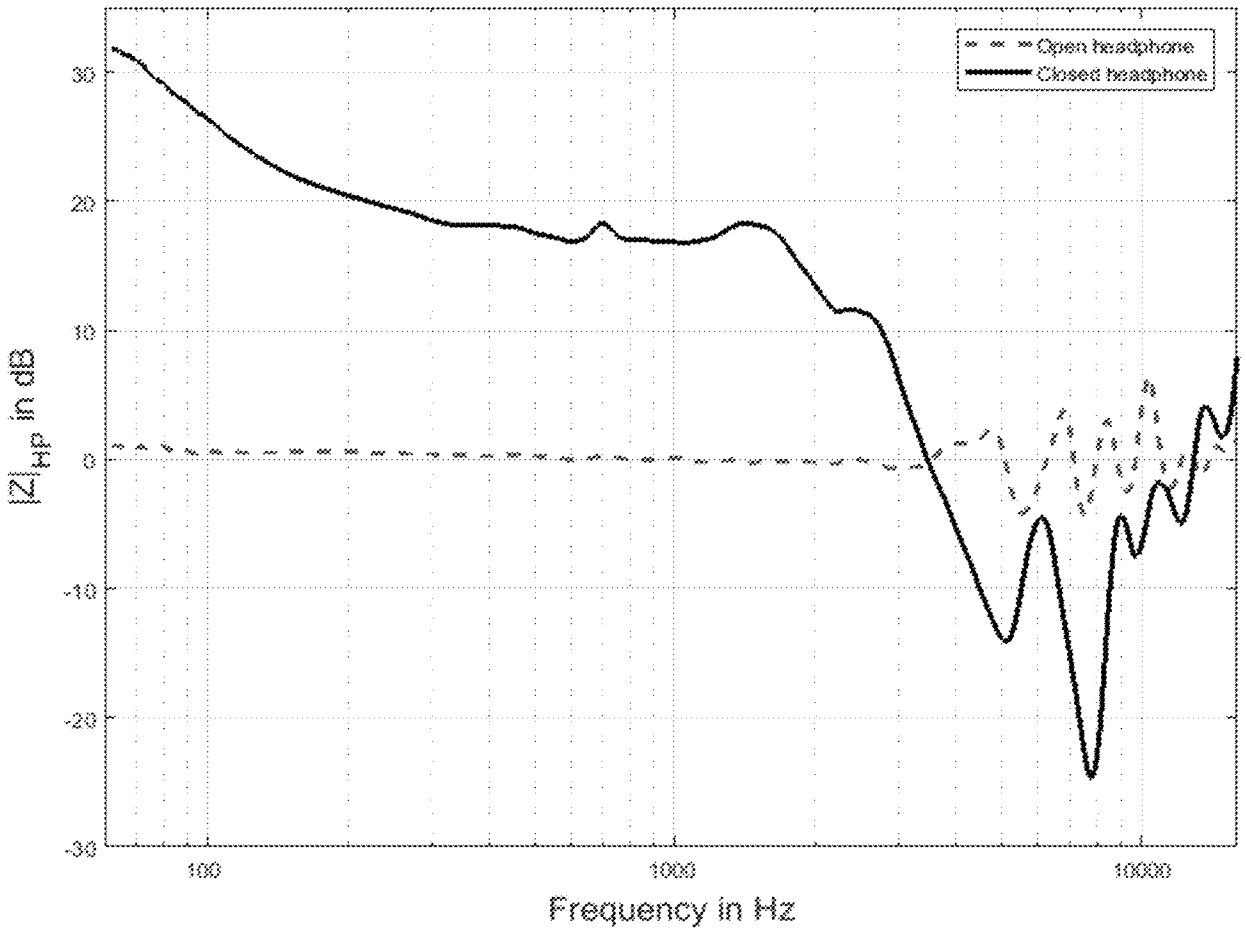
FIG. 7 shows an example of an acoustic impedance of open headphone and an acoustic impedance of closed headphone.

FIG. 7 shows an example of the acoustic impedance of open and closed headphones. The dashed line shows the acoustic impedance of an open headphone. The perceived occlusion effect for the open headphone is very low. The solid line shows the acoustic impedance of a closed earphone. The increased impedance in the low frequency range up to 1.5 kHz boosts the low frequency sound level, which corresponds to a high perceived occlusion.

Figure 8:
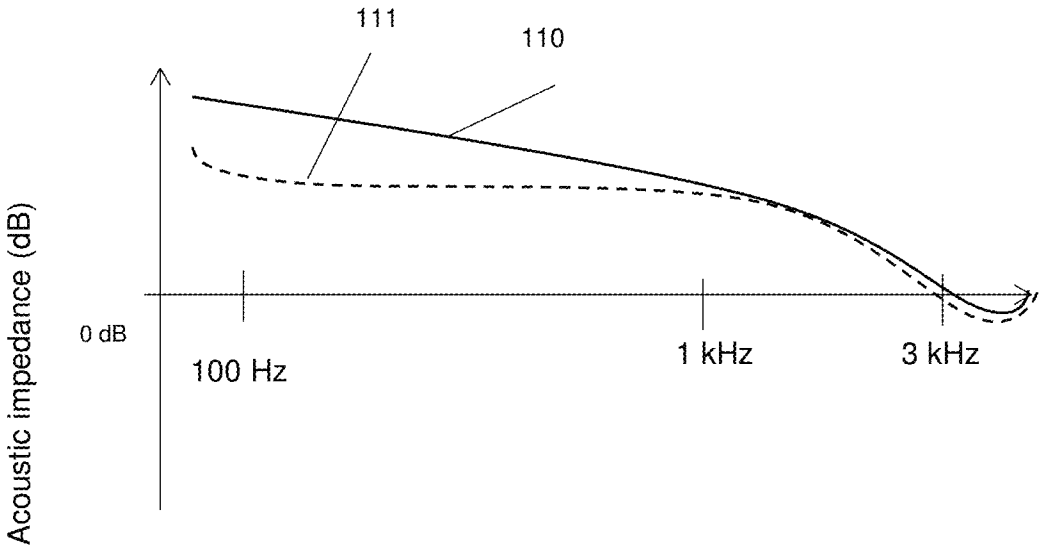
FIG. 8 shows an example of acoustic impedances for an in-ear headphone and an earbud headphone.

The curves 110, 111 in FIG. 8 show exemplary results of acoustic impedances for in-ear headphones 110 and ear-bud headphones 111. The impedance of ear-bud headphones 111 is lower than the impedance of in-ear headphones 110 up to a frequency of about 1 kHz.

Figure 9:
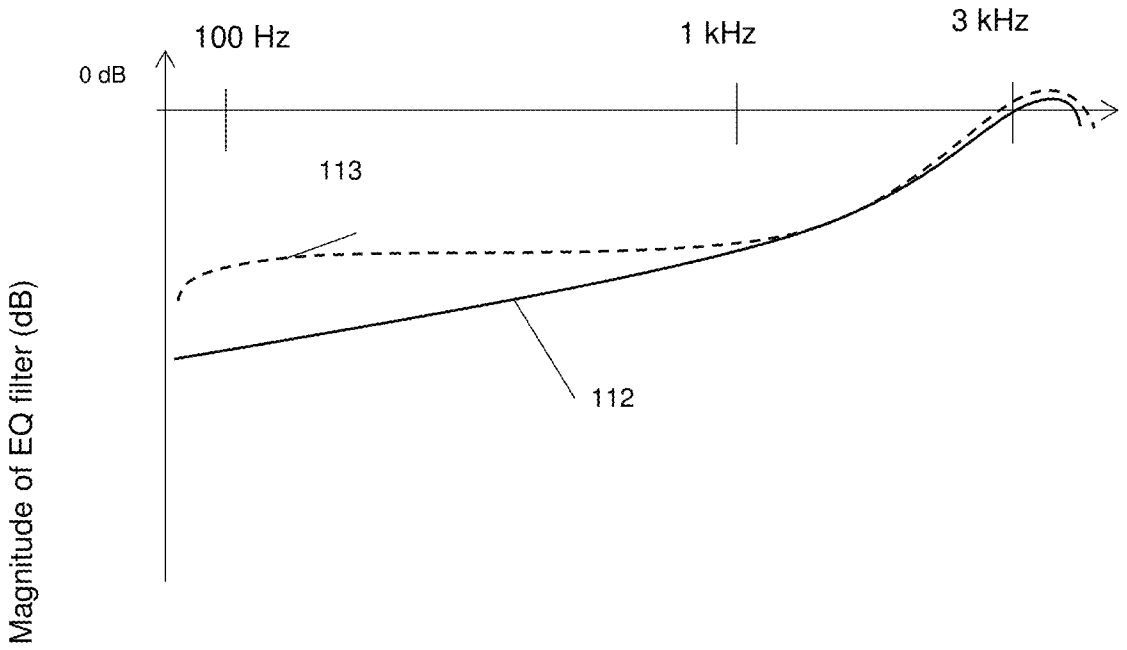
FIG. 9 shows an example of frequency curve for an equalization filter.

The gain factor/shape (g) of an equalization filter is proportional to the inverse of $Z_{HP}$.

$$g = \alpha\frac{1}{Z_{HP}},$$

where $\alpha$0 is the scaling factor (proportional coefficient), which can either be selected by the user or determined during a lot of measurement of different headphones. FIG. 9 shows the exemplary target frequency curve for the equalization filter to reduce the occlusion effect and to improve naturalness of user's own voice. 112 shows the target response curve for the in-ear headphone, and 113 shows the target response curve for the ear bud.

Figure 13:
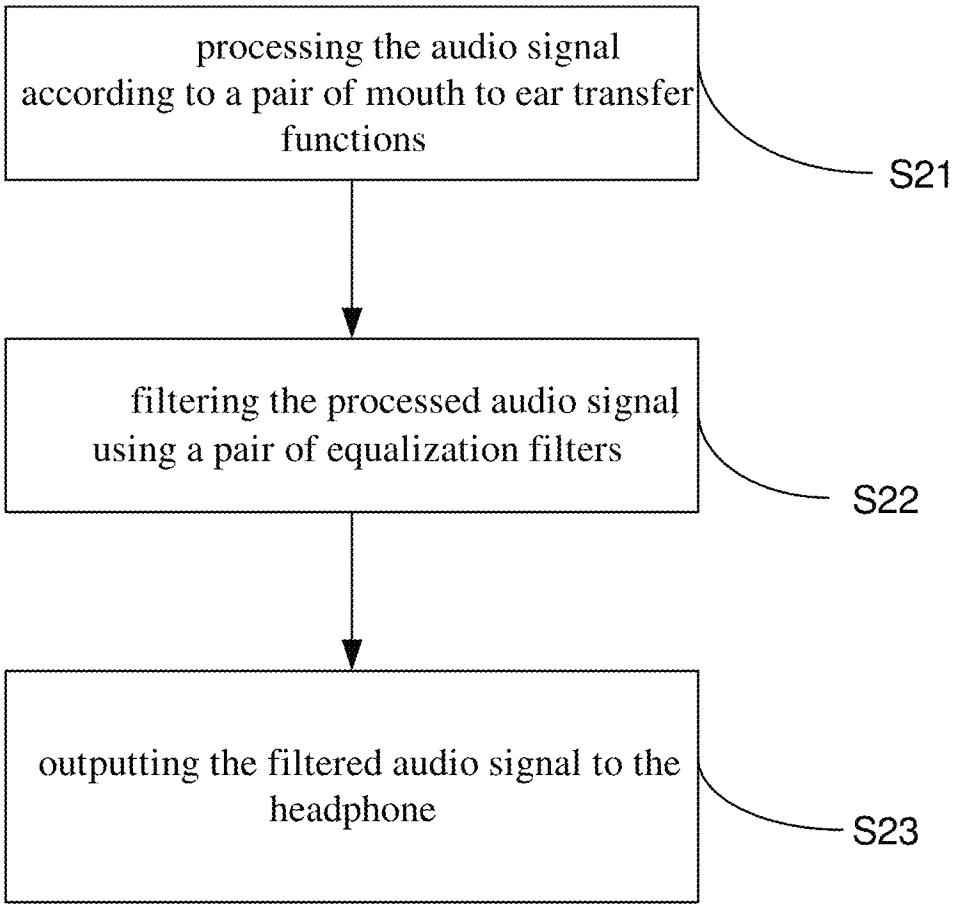
FIG. 13 shows a signal processing chart of a method for processing an audio signal according to an embodiment.

FIG. 13 shows a schematic diagram of a method for processing an audio signal according to an embodiment. The method includes:

S21: processing the audio signal according to a pair of mouth to ear transfer functions.

S22: filtering the processed audio signal, using a pair of equalization filters.

S23: outputting the filtered audio signal to the headphone.

Embodiment 1, telephone with headset (in-ear headphone or earbuds with in-line microphone) in a quiet environment.

Figure 10:
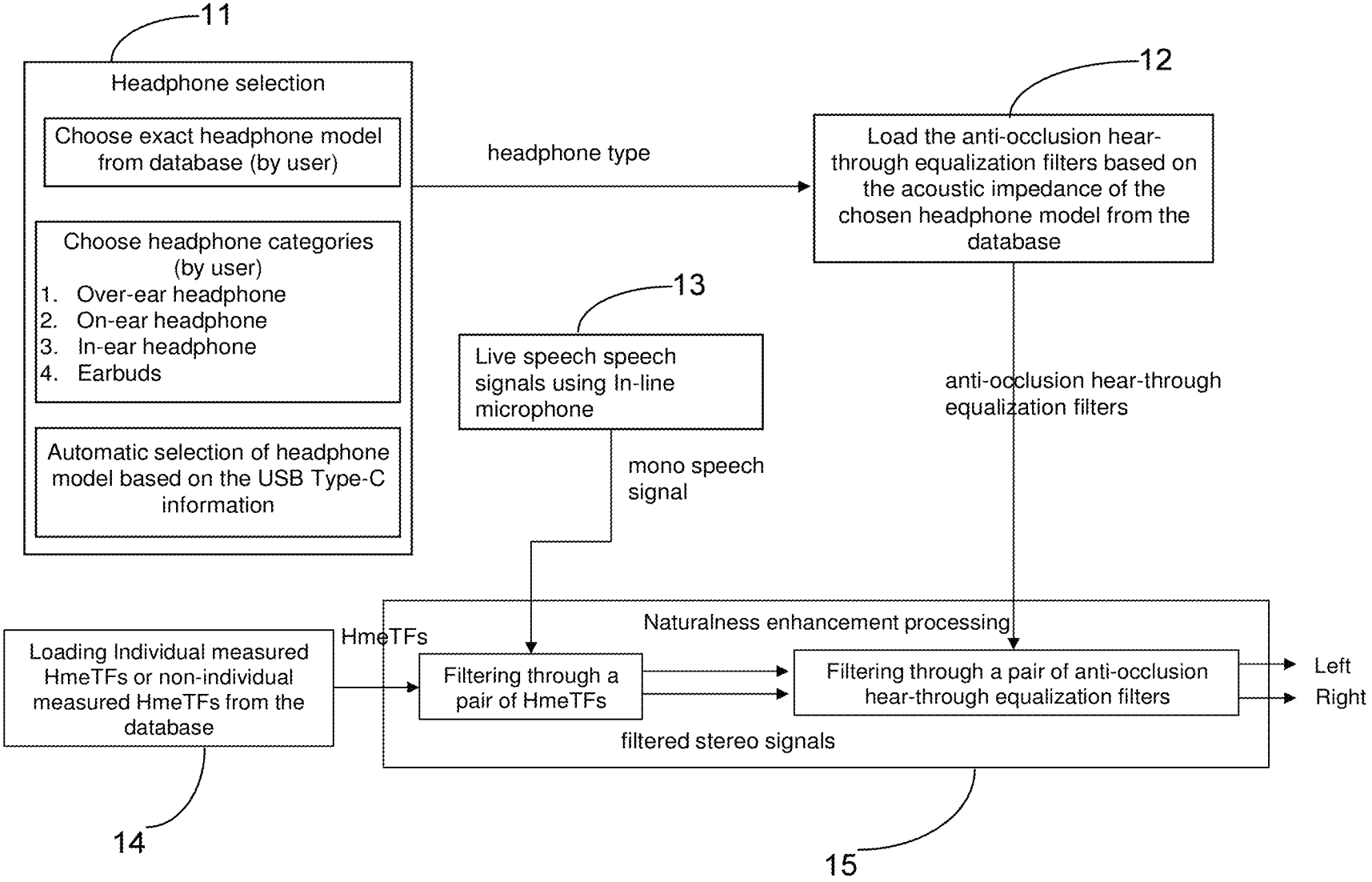
FIG. 10 shows a signal processing chart of a method of using a telephone with a headset in a quiet environment according to an embodiment.

FIG. 10 shows a block diagram of this embodiment. A user's own voice (air-transmitted) is captured using an in-line microphone of the headphone used. The captured speech signal 13 is filtered through a pair of mouth-to-ear transfer functions (HmeTFs), which can be individually or non-individually determined 14 before. The filtered speech signals are then further filtered through a pair of anti-occlusion hear-through equalization filters to enhance the high pass component of user's own voice. The filtered signals are then played back using headphones to the user and the naturalness while the user is speaking is enhanced.

The anti-occlusion hear-through equalization filter 12 is pre-designed based on the acoustic impedance of the headphone. Therefore, information of the headphone used is required. It can be done either manually or automatically. For example, the headphone can be selected 11 by the user manually based on the headphone categories (for example, over-ear headphone, on-ear headphone) or the headphone model (for example, HUAWEI Earbud). It can also be automatically detected by the information provided by the USB type-C. For each headphone, the anti-occlusion hear-through equalization filter is then chosen based on its acoustic impedance, as mentioned above. For each category, a filter can be designed based on an averaged acoustic impedance or use a representative equalization filter for each category.

The shape of the filter should be proportional to the inverse of the acoustic impedance ($0-Z_{HP}$ in dB). For the design of the anti-occlusion hear-through equalization filter, almost every low order infinite impulse response (IIR) filter or finite impulse response (FIR) filter is suitable (low latency is needed).

Figure 11:
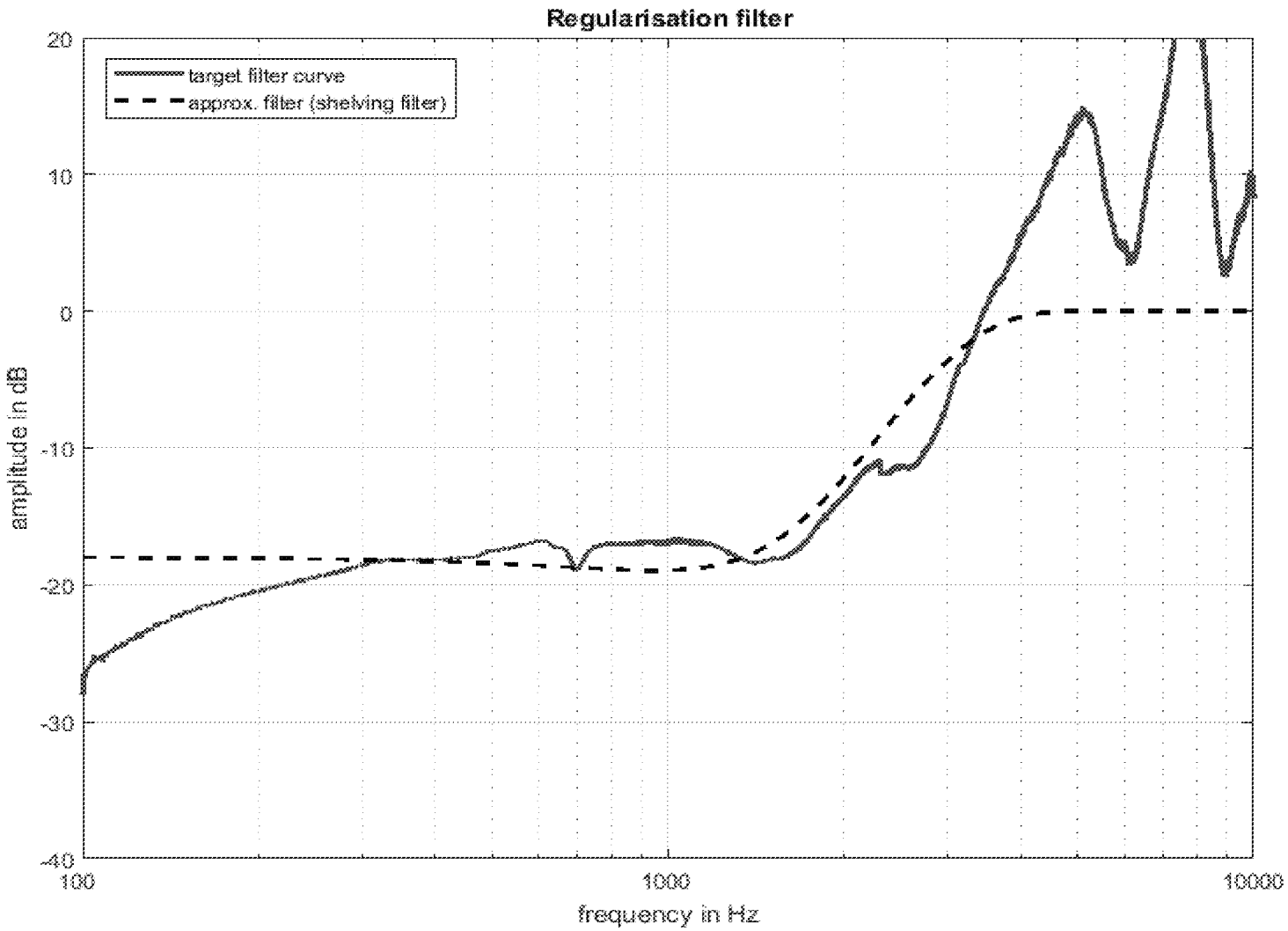
FIG. 11 shows an example of a high-pass shelving filter according to an embodiment.
Figure 12:
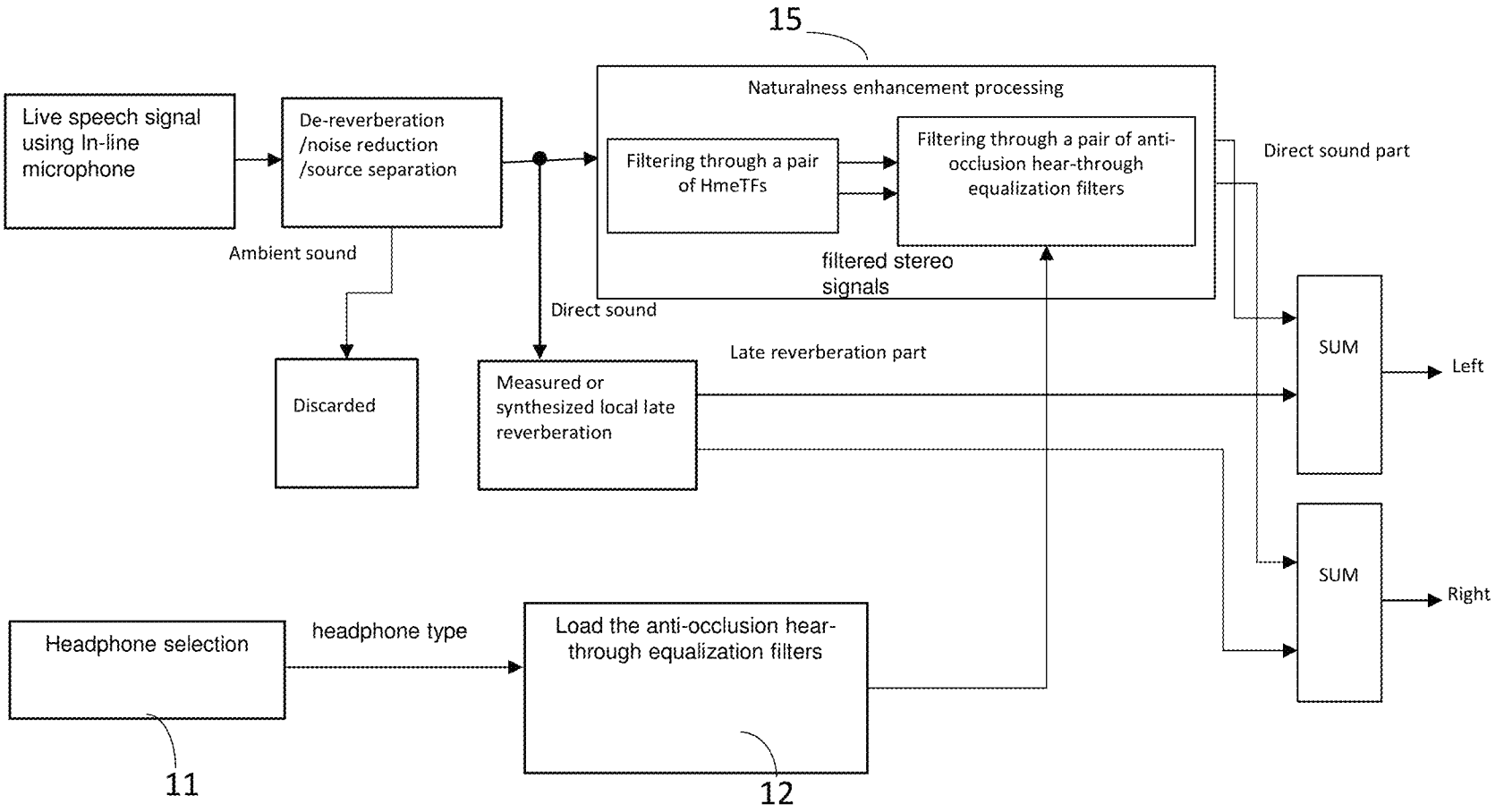
FIG. 12 shows a signal processing chart of a method of using a telephone with a headset in a noisy environment according to an embodiment.

FIG. 11 shows an example in which a high-pass shelving filter (FIR-filter) is used for the design of an anti-occlusion hear-through equalization filter in one implementation. Also, other filters, such as an implementation with a Chebyshev-II IIR-filter, can be used.

The filter can be designed in two steps:

1) The stopband attenuation can be determined by averaged acoustic impedance from low (60 Hz) to the cut-off frequency as a starting point. Then the cut-off frequency can be determined by the first zero crossing of the frequency dependent acoustic impedance, seen from the low to the high frequency.
2) Iterating the stopband attenuation and the cut-off frequency by minimizing the error between the inverse of the acoustic impedance curve (target) and the designed frequency response (such as, using machine learning).

For example, the cut-off frequency is 3.5 kHz of an in-box earbuds, and the stopband attenuation is 16 dB. The pre-designed filters can be stored in the cloud, in an online database provided to user or in the smartphone, for example.

Embodiment 2, telephone with headset (in-ear headphone or earbuds with in-line microphone) in a noisy environment.

As an example, a user is making a teleconference with a headset in a noisy room, for example a restaurant or an airport. The user's own voice captured by the in-line microphone is combined with the environment noise, and this may decrease the naturalness perception. In addition, the user does not want the remote user to hear the environment noise as this may reduce the speech intelligibility.

Therefore, in the case of noisy environments, the captured user's voice is first decomposed into direct sound and ambient sound. The ambient sound is discarded. The extracted direct sound is filtered through a pair of HmeTFs and is further filtered through a pair of anti-occlusion hear-through equalization filters to simulate the direct sound part. The measured or synthesized late reverberation part is added to the direct part to simulate the quite environment but with local room information. The signals are then played back using headphones to the user and the naturalness while user is speaking is enhanced. In addition, the extracted direct sound can be sent to the remote user to enhance the speech intelligibility.

In one embodiment, the binaural signals are the sum of direct sound, early reflections and late reverberation:

$$\text{Left}=d_{left}(t)+e_{left}(t)+l_{left}(t)$$

$$\text{Right}=d_{right}(t)+e_{right}(t)+l_{right}(t)$$

Figure 14:
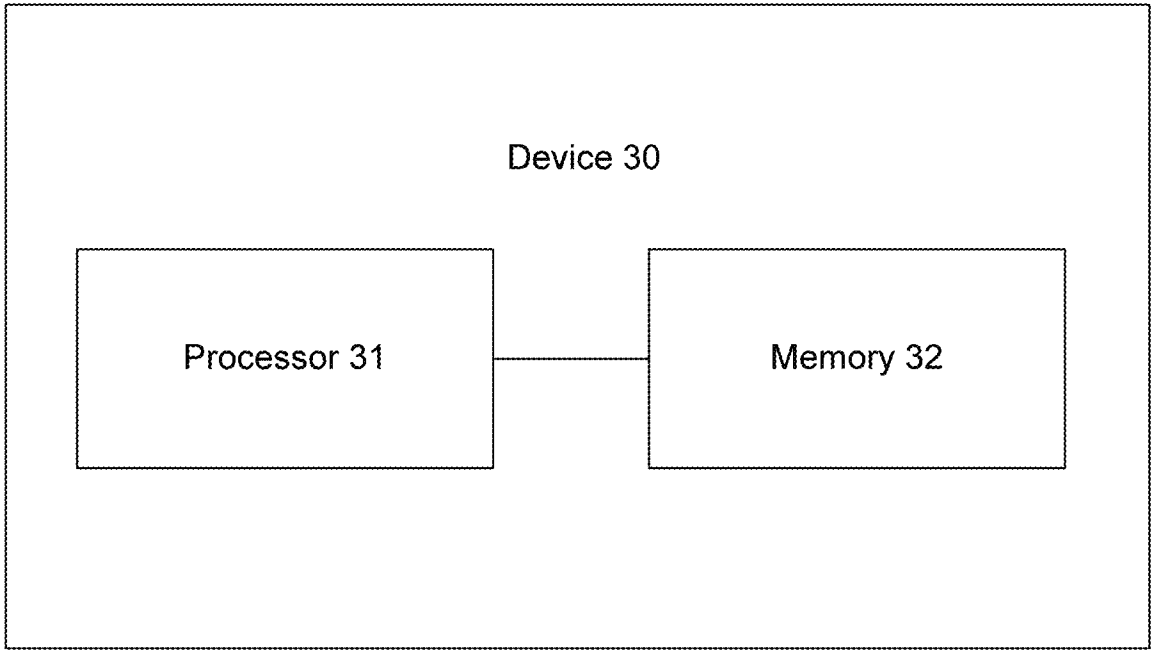
FIG. 14 shows a schematic diagram illustrating a device for processing an audio signal according to an embodiment.

FIG. 14 shows a schematic diagram of a device 30 for processing an audio signal according to an embodiment. The device 30 includes a processor 31 and a computer-readable storage medium 32 storing program code. The program code includes instructions for carrying out embodiments of the method for processing an audio signal or one of its implementations.

Applications of embodiments include any sound reproduction system or surround sound system using multiple loudspeakers. In particular, embodiments can be applied to, for example:

TV speaker systems,
car entertaining systems,
teleconference systems, and/or
home cinema system,
where personal listening environments for one or multiple listeners is desirable.

The foregoing are only implementation manners of the present embodiments, and the embodiments are non-limiting. Any variations or replacements can be easily made by a person of ordinary skill in the art.

The invention claimed is:

1. A method for processing an audio signal, comprising:
processing the audio signal according to a pair of mouth to ear transfer functions to obtain a processed audio signal;
filtering the processed audio signal, using a pair of equalization filters, to obtain a filtered audio signal, wherein a parameter of the equalization filter depends on an acoustic impedance of a headphone; and
outputting the filtered audio signal to the headphone.

2. The method of claim 1, wherein the mouth to ear transfer function describes a transfer function from the mouth to the eardrums.

3. The method of claim 1, wherein the acoustic impedance of the headphone is measured based on an acoustic impedance tube, the acoustic impedance tube having a measurable frequency range from 20 Hz to 2 kHz.

4. The method of claim 1, wherein the parameter of the equalization filter is a gain factor of the equalization filter, and the gain factor of the equalization filter is proportional to the inverse of the acoustic impedance of the headphone.

5. The method of claim 1, wherein the pair of equalization filters is selected based on a headphone type of the headphone.

6. The method of claim 5, wherein the headphone type of the headphone is obtained based on a Universal Serial Bus (USB) Type-C information.

7. An apparatus for processing a stereo signal , the apparatus comprising processing circuitry configured to:
process an audio signal according to a pair of mouth to ear transfer functions to obtain a processed audio signal;
filter the processed audio signal, using a pair of equalization filters, to obtain a filtered audio signal, wherein a parameter of the equalization filter depends on an acoustic impedance of a headphone; and
output the filtered audio signal to the headphone.

8. The apparatus of claim 7, wherein the mouth to ear transfer function describes a transfer function from the mouth to the eardrums.

9. The apparatus of claim 7, wherein the acoustic impedance of the headphone is measured based on an acoustic impedance tube, the acoustic impedance tube having a measurable frequency range from 20 Hz to 2 kHz.

10. The apparatus of claim 7, wherein the parameter of the equalization filter is a gain factor of the equalization filter, the gain factor of the equalization filter being proportional to the inverse of the acoustic impedance of the headphone.

11. The apparatus of claim 7, wherein the pair of equalization filters is selected based on a headphone type of the headphone.

12. The apparatus of claim 11, wherein the headphone type of the headphone is obtained based on a Universal Serial Bus (USB) Type-C information.

13. A non-transitory computer-readable storage medium storing program code which, when executed by a computer, causes the computer to carry out a method comprising:

processing an audio signal according to a pair of mouth to ear transfer functions to obtain a processed audio signal;

filtering the processed audio signal, using a pair of equalization filters, to obtain a filtered audio signal, wherein a parameter of the equalization filter depends on an acoustic impedance of a headphone; and outputting the filtered audio signal to the headphone.

* * * * *